US011566483B2

(12) United States Patent
Naffaa et al.

(10) Patent No.: US 11,566,483 B2
(45) Date of Patent: Jan. 31, 2023

(54) TRI-AXTAL OSCILLATOR FOR STUCK PIPE RELEASE

(71) Applicant: Saudi Arabian Oil Company, Dhahran (SA)

(72) Inventors: Youniss Mahmoud Naffaa, Dhahran (SA); Opeyemi Adewuya, Dhahran (SA); Abdulsalam Alwarthan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 156 days.

(21) Appl. No.: 16/953,032

(22) Filed: Nov. 19, 2020

(65) Prior Publication Data

US 2022/0154543 A1 May 19, 2022

(51) Int. Cl.
*E21B 31/00* (2006.01)

(52) U.S. Cl.
CPC ..... *E21B 31/005* (2013.01)

(58) Field of Classification Search
CPC ..... E21B 31/005
See application file for complete search history.

(56) References Cited

U.S. PATENT DOCUMENTS 2,016,067 A * 10/1935 Bannister ..... E21B 4/02 175/413
2,970,660 A * 2/1961 Bodine, Jr. ..... E21B 7/24 175/227
3,303,782 A * 2/1967 Bodine, Jr. ..... E21B 43/003 417/241
3,807,512 A * 4/1974 Pogonowski ..... E21B 6/00 175/107
4,088,223 A * 5/1978 Bertrand ..... B06B 1/10 198/761
4,271,915 A * 6/1981 Bodine ..... E21B 4/02 418/48
6,910,542 B1 * 6/2005 Walter ..... E21B 4/20 175/93
9,200,494 B2 11/2015 Bakken
9,470,055 B2 10/2016 Harrigan et al.
9,797,211 B2 10/2017 Xu et al.
10,280,700 B2 5/2019 Moyes
(Continued)

FOREIGN PATENT DOCUMENTS

WO 2020089734 A1 5/2020

OTHER PUBLICATIONS

Jose L. Mercado, "Planning for Successful Jarring Operations—Effective Use of Drilling Impact System Helps Release Stuck Pipe", SPE/IADC Drilling Conference and Exhibition, SPE-163413, Mar. 2013, pp. 1-9.

*Primary Examiner* — Shane Bomar
(74) *Attorney, Agent, or Firm* — Bracewell LLP; Constance G. Rhebergen; Keith R. Derrington

(57) ABSTRACT

Systems and methods for oscillating a string within a subterranean well include a motor assembly having an output shaft extending along a central axis. A translation coupling is in mechanical communication with the output shaft. An inertia sleeve is in mechanical communication with the translation coupling. The translation coupling is operable to translate a rotation of the output shaft to an oscillating movement of the inertia sleeve. A spring assembly is in mechanical communication with the inertia sleeve. The spring assembly is positioned along the central axis.

17 Claims, 2 Drawing Sheets

(56) References Cited

U.S. PATENT DOCUMENTS

| | | | | |
|---|---|---|---|---|
| 10,435,975 | B2 * | 10/2019 | Greenwood | E21B 4/16 |
| 10,544,657 | B2 * | 1/2020 | MacDougall | E21B 47/092 |
| 10,590,709 | B2 | 3/2020 | Sicilian et al. | |
| 2005/0284624 | A1 | 12/2005 | Libby et al. | |
| 2010/0065330 | A1 * | 3/2010 | Walter | E21B 4/14 175/56 |
| 2012/0048621 | A1 | 2/2012 | Stewart et al. | |
| 2013/0146360 | A1 * | 6/2013 | Yajure | E21B 7/24 175/55 |
| 2014/0054090 | A1 * | 2/2014 | Schicker | E21B 4/10 173/205 |
| 2014/0174726 | A1 * | 6/2014 | Harrigan | E21B 28/00 166/177.2 |
| 2016/0194917 | A1 * | 7/2016 | Alali | E21B 7/24 175/322 |
| 2016/0356089 | A1 * | 12/2016 | Nanayakkara | E21B 4/006 |
| 2017/0226806 | A1 * | 8/2017 | Nguyen | E21B 4/06 |
| 2017/0370189 | A1 * | 12/2017 | MacDougall | E21B 34/14 |
| 2020/0048975 | A1 | 2/2020 | Feng et al. | |
| 2020/0149367 | A1 | 5/2020 | Doster et al. | |

* cited by examiner

TRI-AXTAL OSCILLATOR FOR STUCK PIPE RELEASE

BACKGROUND OF THE DISCLOSURE

1. Field of the Disclosure

The disclosure relates generally to the drilling, completion, and operation of a subterranean well, and more particularly to the movement of drill string and tubular members within the subterranean well.

2. Description of the Related Art

A stuck pipe within a subterranean well is a cause of lost time during drilling and completion operations, especially in deviated and horizontal wells. While drilling, logging or running completion assemblies into a wellbore, the drilling or completion or wireline assembly can get stuck. A stuck pipe can mean that all motion, such as movement either into the well or out of the well, or rotation of the string, is no longer possible because the drilling or completion or wireline assembly has encountered an interference to the motion imposed by mechanical or hydraulic differential pressure forces.

A stuck pipe can have a variety of causes, including mechanical sticking such as well packing off, wellbore geometry, or bridging, or can be caused by differential sticking. Problems resulting from a stuck pipe can range from incidents causing an increase in costs, to incidents where it takes days to get the pipe unstuck or incidents that require expensive remedial action to complete the well. In extreme cases where the problem cannot be resolved, the bore may have to be plugged and abandoned.

In some current subterranean well operations, if any stuck pipe, hold up, or obstruction event is encountered, the remedial operations are limited to either over-pull or slack-off of the stuck pipe, jarring up or down of the stuck pipe, attempted rotation of the stuck pipe, or pumping or circulating drilling fluids within the wellbore in an attempt to free the stuck pipe or move past the obstruction.

SUMMARY OF THE DISCLOSURE

Embodiments of this disclosure include systems and methods for generating large tri-axial motion and forces while oscillating to generate vibration to free or dislodge a stuck drill string or other tubular or wireline tool in a wellbore. The tri-axial oscillator tool is activated by pumping fluid at a preset activation flow rate or differential pressure. Alternately, the tri-axial oscillator tool can be activated by sending wireless commands to an electrohydraulic actuator.

The tri-axial oscillator tool is run as part of the drill string, tubular, or wireline tool string during drilling or tripping or logging operations, and can be run as part of a completions assembly. The tri-axial oscillator tool can exert downhole forces in a tri-axial direction closer to the stuck point than currently available solutions. The tri-axial oscillator tool can further apply forces from the surface such as pull, push, or rotational forces, to significantly increase the probability of releasing the stuck tubular or pipe from the physical restriction or differential pressure overbalance generating the hold down force.

In an embodiment of this disclosure, a system for oscillating a string within a subterranean well has a motor assembly having an output shaft extending along a central axis. A translation coupling is in mechanical communication with the output shaft. An inertia sleeve is in mechanical communication with the translation coupling. The translation coupling is operable to translate a rotation of the output shaft to an oscillating movement of the inertia sleeve. A spring assembly is in mechanical communication with the inertia sleeve. The spring assembly is positioned along the central axis.

In alternate embodiments, the oscillating movement of the inertia sleeve can include an axial movement component in a direction parallel to the central axis. The oscillating movement of the inertia sleeve can alternately include a lateral movement component in a direction transverse to the central axis. The inertia sleeve can include a plurality of ports oriented to generate a radial vibration in response to a flow of fluid.

In other alternate embodiments, the system can further include a tool housing, where the tool housing is an elongated tubular member housing the translation coupling, the inertia sleeve, and the spring assembly. The spring assembly can include a plurality of stacked disc springs.

In an alternate embodiment of this disclosure, a system for oscillating a string within a subterranean well has a tri-axial oscillator tool. The tri-axial oscillator tool includes a motor assembly having an output shaft extending along a central axis. An uphole connector is secured in line with an uphole string member. A translation coupling is in mechanical communication with a downhole end of the output shaft. An inertia sleeve is in mechanical communication with the translation coupling. The inertia sleeve is rotatable by the translation coupling and the translation coupling is operable to translate a rotation of the output shaft to an oscillating movement of the inertia sleeve. The oscillating movement includes an axial movement component in a direction parallel to the central axis. A spring assembly is in mechanical communication with the inertia sleeve. The spring assembly is positioned along the central axis. The tri-axial oscillator tool is positioned proximate to a sticking point of the string within the subterranean well.

In alternate embodiments, the oscillating movement of the inertia sleeve can include a lateral movement component in a direction traverse to the central axis. The inertia sleeve can include a plurality of ports, each moveable between a port open position and a port closed position for generating a radial vibration in response to a flow of fluid. The tri-axial oscillator tool can further include a downhole connector secured in line with a downhole string member.

In another alternate embodiment of this disclosure, a method for oscillating a string within a subterranean well includes providing a motor assembly having an output shaft extending along a central axis. A translation coupling is mechanically connected to the output shaft. An inertia sleeve is mechanically connected to the translation coupling, where the translation coupling translates a rotation of the output shaft to an oscillating movement of the inertia sleeve. A spring assembly is positioned along the central axis in mechanical communication with the inertia sleeve. The motor assembly, the translation coupling, the inertia sleeve, and the spring assembly define a tri-axial oscillator tool. The output shaft is rotated to produce the rotation and the oscillating movement of the inertia sleeve.

In alternate embodiments, the tri-axial oscillator tool can be secured in line with an uphole string member with an uphole connector. Alternately, the tri-axial oscillator tool can be secured in line with a downhole string member with a downhole connector. Producing the oscillating movement of the inertia sleeve can include producing an axial movement component in a direction parallel to the central axis. Alternately, producing the oscillating movement of the inertia sleeve can include producing a lateral movement component in a direction transverse to the central axis. The inertia sleeve can include a plurality of ports, and the method can further include delivering a flow of fluid to the plurality of ports and moving the plurality of ports between a port open and a port closed position to generate a radial vibration of the inertia sleeve.

In other alternate embodiments, the translation coupling, the inertia sleeve, and the spring assembly can be housed within a tool housing, where the tool housing is an elongated tubular member. Positioning the spring assembly along the central axis can include positioning a plurality of stacked disc springs along the central axis. The method can further include positioning the tri-axial oscillator tool proximate to a sticking point of the string within the subterranean well. The motor assembly can include a rotor and a stator and the method can further include rotating the rotor within the stator by providing a flow of fluid to the motor assembly.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
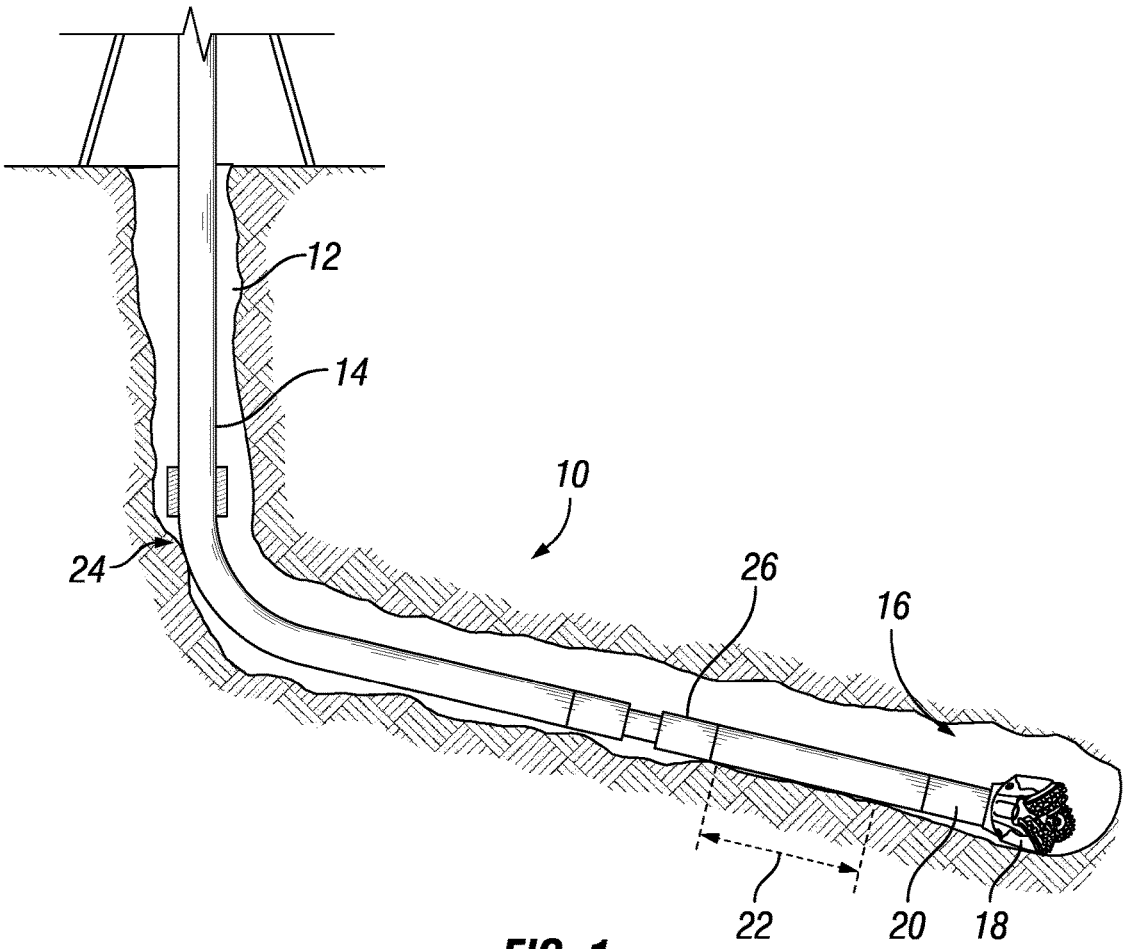
FIG. 1 is a schematic sectional representation of a subterranean well having a tri-axial oscillator tool, in accordance with an embodiment of this disclosure.

Referring to FIG. 1, subterranean well 10 extends downwards from a surface of the earth, which can be a ground level surface or a subsea surface. Wellbore 12 of subterranean well 10 can be extended generally vertically relative to the surface. Wellbore 12 can alternately include portions that extend generally horizontally or in other directions that deviate from generally vertically from the surface. Subterranean well 10 can be a well associated with hydrocarbon development operations, such as, for example, a hydrocarbon production well, an injection well, or a water well.

String 14 extends into wellbore 12 of subterranean well 10. In the example embodiment shown in FIG. 1, string 14 is a drill string. In alternate embodiments, string 14 can be, for example, a casing string, a work string, or another tubular member lowered into the subterranean well. String 14 can alternately be coiled tubing, an e-line, a wireline, or other elongated member. In this disclosure, the term "stuck pipe" is used to describe any string 14 that is stuck, where the stuck pipe can be either a tubular member or a non-tubular member. Wellbore 12 can be an uncased opening. In embodiments where string 14 is an inner tubular member, wellbore 12 can be part of an outer tubular member, such as a casing.

String 14 can include downhole tools and equipment that are secured in line with joints of string 14. String 14 can have, for example, bottom hole assembly 16 that can include drilling bit 18 and logging while drilling tools 20. Drilling bit 18 can rotate to create wellbore 12 of subterranean well 10. Logging while drilling tools 20 can be used to measure properties of the formation adjacent to subterranean well 10 as wellbore 12 is being drilled. Logging while drilling tools 20 can also include measurement while drilling tools that can gather data regarding conditions of and within wellbore 12, such as the azimuth and inclination of wellbore 12.

As string 14 moves through wellbore 12, there may be times when string 14 is at risk of becoming stuck or does become stuck. The risk of becoming stuck increases, for example, in wellbores 12 with an uneven inner surface or wellbores 12 that have a change in direction. A non-limiting example of a stuck point or stuck section 22 (collectively referred to as a "sticking point") is shown in FIG. 1, where string 14 is unable to move in the axial uphole or downhole direction or move in a rotational direction. In the Examiner of FIG. 1, at stuck point 22, string 14 makes contact with the inner surface of wellbore 12. In some embodiments, stuck point 22 is caused by differential sticking.

FIG. 1 also shows a potential obstruction stuck point 24. At obstruction stuck point 24, a shoulder or collar of string 14 will contact a portion of the inner surface of wellbore 12. Contact between the shoulder of string 14 and the inner surface of wellbore 12 will result in friction between the shoulder of string 14 and the inner surface of wellbore 12, will cause a mechanical interference between the shoulder of string 14 and the inner surface of wellbore 12, and will induce a bending moment in string 14.

If string 14 does become stuck, systems and methods of this disclosure can be used to improve the probability of unsticking and freeing string 14. If string 14 becomes a stuck pipe, tri-axial oscillator tool 26 can be used to unstick the stuck pipe.

Figure 2:
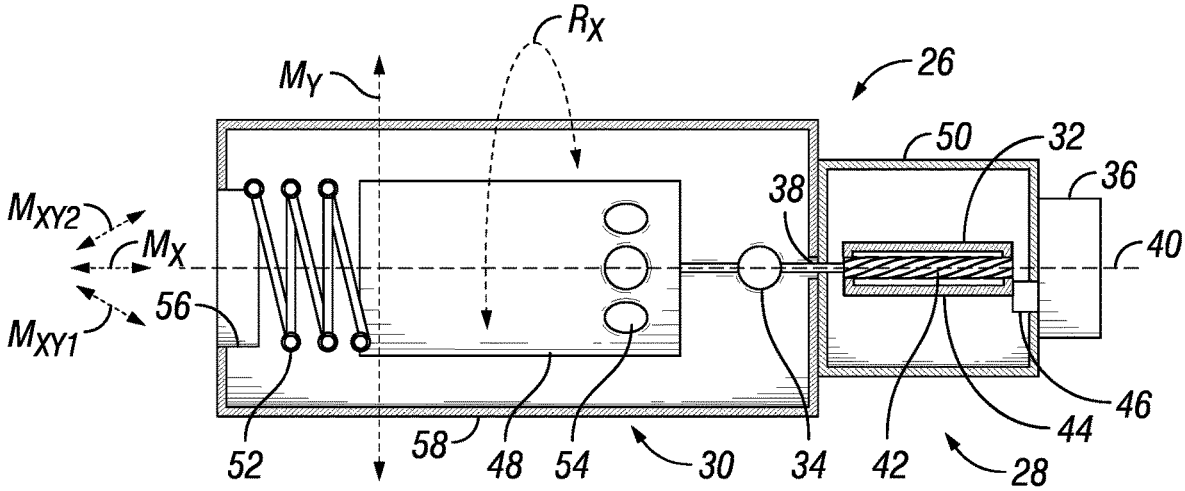
FIG. 2 is a schematic perspective view of a tri-axial oscillator tool, in accordance with an embodiment of this disclosure.

Looking at FIG. 2, a schematic representation of tri-axial oscillator tool 26 is shown. Tri-axial oscillator tool 26 is divided into two main sections. The two main sections include an actuation module 28 and an oscillation module 30. In the embodiment of FIG. 2, actuation module 28 is at the uphole end of tri-axial oscillator tool 26 and oscillation module 30 is located at the downhole end of tri-axial oscillator tool 26.

In the example embodiment of FIG. 2, actuation module 28 includes motor assembly 32. Actuation module of tri-axial oscillator tool 26 further includes uphole connector 36 at a terminal uphole end of tri-axial oscillator tool 26. Uphole connector 36 is secured in line with an uphole string member of string 14 (FIG. 1). Uphole connector 36 can be a threaded member, a bolted member, or another type of commonly used connector for connecting tools in line with string 14.

Motor assembly 32 has output shaft 38 that expends along central axis 40. Central axis 40 extends along the center of the elongated length of tri-axial oscillator tool 26. In this disclosure, central axis 40 is considered to extend along an x-axis. Output shaft 38 is rotated by motor assembly 32.

In the example of FIG. 2, motor assembly 32 includes a progressive cavity positive displacement pump with rotor 42 and stator 44. A progressive cavity positive displacement pump includes a helical rotor with one or more lobes that rotates eccentrically when the stator contains more lobes than the rotor. In an embodiment, a rotor with two lobes used with a stator having three lobes is operable to deliver greater vibrational pound forces at rotational acceleration rates measured in feet per second squared, than currently available systems.

A flow of the fluid between the rotor and stator causes the rotation of the rotor. Valve controller assembly 46 can operate motor assembly 32 in response to hydraulic differential pressure signals. Valve controller assembly 46 can include an electrohydraulic actuator that can detect a hydraulic pulse activation command. Upon receipt of the hydraulic pulse activation command, tri-axial oscillator tool 26 will be activated to produce oscillations to unstick string 14. Alternately, valve controller assembly 46 can be instructed with a wireless signal to actuate tri-axial oscillator tool 26.

Actuation housing 50 houses the components of actuation module 28, such as motor assembly 32 and valve controller assembly 46. Actuation housing 50 is an elongated tubular member with the components of actuation module 28 being located within the open bore of actuation housing 50.

Oscillation module 30 includes translation coupling 34, inertia sleeve 48, and spring assembly 52. Translation coupling 34 is in mechanical communication with output shaft 38 so that when motor assembly 32 is activated and output shaft 38 rotates, translation coupling 34 also rotates. As will be described in relation to FIGS. 3 and 4, rotation of translation coupling 34 will result in both rotation and an oscillating movement of inertia sleeve 48.

Inertia sleeve 48 is in mechanical communication with translation coupling 34. Translation coupling 34 can translate a rotation of output shaft 38 to an oscillating movement of inertia sleeve 48. Inertia sleeve 48 can be rotated by output shaft 38 by way of translation coupling 34. The rotation of inertia sleeve is in a direction about central axis 40, as indicated by the arrow labeled Rx. Rx is an arrow that is showing rotation about an x-axis. Output shaft 38 can rotate inertia sleeve 48 at high speeds. For example, inertia sleeve 48 can rotate at a speed in a range of 150 rpm to 700 rpm. In alternate embodiments, motor assembly 32 can rotate output shaft 38 at a speed of up to 600 rpm with a frequency in a range of 15 Hz to 20 Hz. The frequency is measured as the oscillation rate from the axial motion imparted by the swash plate 72 (FIG. 4) and rotor motion.

Inertia sleeve 48 includes ports 54. Ports 54 can be moved sequentially between a port open position and a port closed position. The ports 54 are oriented so that as fluid is delivered through or past inertia sleeve 48, the sequential movement of ports 54 between port open positions and port closed positions will result in radial oscillation of inertia sleeve 48. Radial oscillation of inertia sleeve 48 is oscillation about central axis 40. As inertia sleeve 48 rotates, the rotation is oscillatory in nature. That is, the rotation includes vibration or changes in speed of the rotation of inertia sleeve 48.

Spring assembly 52 is in mechanical communication with inertia sleeve 48. Spring assembly 52 is positioned along central axis 40. Translation coupling 34 can further translate the rotation of output shaft 38 to an oscillating movement of inertia sleeve 48 that includes an axial movement of inertia sleeve 48 in a direction indicated by arrow labeled Mx that is parallel to central axis 40. As inertia sleeve 48 moves axially, spring assembly 52 absorbs and amplifies the axial movement of inertia sleeve 48. In FIG. 2, spring assembly 52 includes a compression spring. In alternate embodiments, other types of springs, such as disk springs can be used. As an example, spring assembly 52 can include a plurality of stacked disc springs. In embodiments of this disclosure, spring assembly 52 can be a high rate disk spring stack, which can be known as Belleville spring washers. The high spring rate can be a spring rate or spring constant in a range of 25,000 to 40,000 lbs/in.

Translation coupling 34 can further translate the rotation of output shaft 38 to an oscillating movement of inertia sleeve 48 that includes a lateral movement of inertia sleeve 48 in a direction indicated by arrow labeled My that is transverse to central axis 40. The arrow My is shown extending along a y-axis. The combination of the axial movement of inertia sleeve 48 and the lateral movement of inertia sleeve 48 can be combined to result in a swaying or wobbling motion, such as motion in directions shown in Mxy1 and Mxy2. Although the nomenclature used indicates movement along and around an x-axis and along a y-axis, movement described as being in a direction along a y-axis could also or alternately be in a direction along a z-axis, where the x, y, and z axis define a three dimensional coordinate system.

Oscillation module 30 of tri-axial oscillator tool 26 further includes downhole connector 56 at a terminal downhole end of tri-axial oscillator tool 26. Downhole connector 56 is secured in line with a downhole string member of string 14 (FIG. 1). Downhole connector 56 can be a threaded member, a bolted member, or another type of commonly used connector for connecting tools in line with string 14.

Tool housing 58 houses the components of oscillation module 30, such as translation coupling 34, inertia sleeve 48, and spring assembly 52. Tool housing 58 is an elongated tubular member with the components of oscillation module 30 being located within the open bore of tool housing 58.

Figure 3:
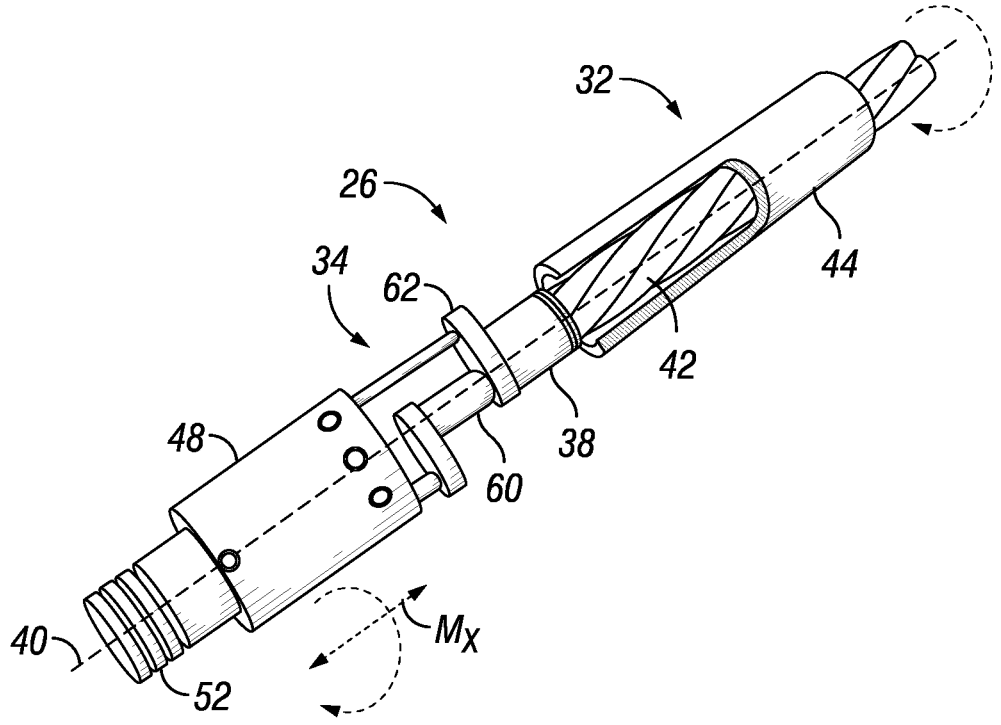
FIG. 3 is a schematic perspective view of inner components of a tri-axial oscillator tool, in accordance with an embodiment of this disclosure.

Looking at FIG. 3, in an example embodiment, translation coupling 34 can include cam assembly 60. In the example of FIG. 3, cam assembly 60 is a double cam system with two cam members 62. As output shaft 38 rotates, each cam member 62 will rotate in a manner that will amplify the axial movement of inertia sleeve 48. In certain embodiments, the eccentric motion of rotor 42 within stator 44 of the progressive cavity positive displacement pump will result in axial movement of translation coupling 34 and inertia sleeve 48. The unequal length of the rods connecting cam members 62 to inertia sleeve 48 will amplify the reciprocating axial motion of rotor 42 to produce a tilt and wobble motion and transmit a high amplitude and frequency vibration motion to the stuck string 14.

Figure 4:
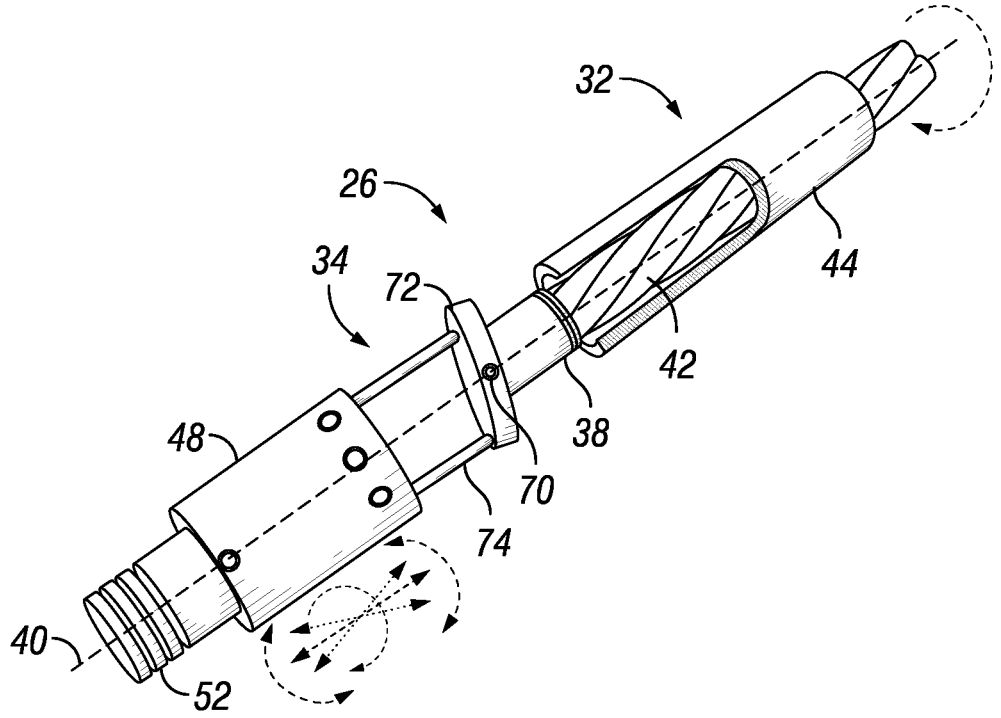
FIG. 4 is a schematic perspective view of an alternate embodiment of inner components of a tri-axial oscillator tool, in accordance with an embodiment of this disclosure.

Looking at FIG. 4, in an example embodiment, translation coupling 34 can include knuckle joint 70 that forms a connection between output shaft 38 and swash plate 72. As output shaft 38 rotates, knuckle joint 70 will allow for relative rotation in varies directions between output shaft 38 and swash plate 72. Bias rods 74 extend between swash plate 72 and inertia sleeve 48. Each of the bias rods 74 can have a different length than other of the bias rods 74. Because the bias rods 74 have different lengths, as swash plate 72 rotates and wobbles, bias rods 74 will cause inertia sleeve 48 to move both in an axial direction and a lateral direction. In certain embodiments, the eccentric motion of rotor 42 within stator 44 of the progressive cavity positive displacement pump will compound or intensify the lateral movement of swash plate 72 and inertia sleeve 48.

In an example of operation, during the drilling and development of a subterranean well 10, one of more tri-axial oscillator tools 26 can be secured in line along string 14. Tri-axial oscillator tool 26 can be positioned along string 14 such that tri-axial oscillator tool 26 is located proximate to stuck point 22 when string 14 becomes a stick pipe. As used in this disclosure, proximate to stuck point 22 means that tri-axial oscillator tool 26 is located in a position that is axially aligned with stuck point 22, or that tri-axial oscillator tool 26 is located in a position that is proximate to stuck point 22.

String 14 can become stuck at a location where stabilizers and reamers have the largest contact surface area. As an example, where stabilizers and reamers are full gauge or are 1/16 of an inch to 1/8 of an inch under-gauge. String 14 can alternately become stuck at the location of a logging while drilling tool that is fitted with a kick pad. An alternate location where string 14 can become stuck is at transition points on string 14 such as where string 14 in a directional wellbore switches under load and wellbore geometry from tension to compression, which produces contact with the wellbore wall and potentially sticking string 14 at such contact point.

In general, the effectiveness of stuck pipe freeing tools diminishes with increasing distance from the stuck point. More particularly, the effectiveness of stuck pipe freeing tools is decreased as the distance between the largest full gauge tool, for example a stabilizer or reamer tool, that produces the greatest friction or drag and the stuck pipe freeing tool increases. In certain embodiments of the current application, the distance between tri-axial oscillator tool 26 and the largest full gauge tool, such as the last stabilizer or reamer tool will be not more than five feet. Alternately, tri-axial oscillator tool 26 can be directly secured uphole of the logging while drilling tool to assist in freeing string 14 if the logging while drilling tool becomes a stuck point. In other alternate embodiments, to augment the effectiveness of a drilling jar, tri-axial oscillator tool 26 can be placed in heavy weight drillpipe above the drilling jar, or can be secured directly to a drill collar below the drilling jar to add vibration to the shock loads generated from the jar action.

If string 14 becomes stuck, tri-axial oscillator tool 26 can be activated to provide a tri-axial oscillation of tri-axial oscillator tool 26 that will be transmitted to string 14 in order to unstick string 14. As an example, tri-axial oscillator tool 26 can be activated by pumping fluid at a preset activation flow rate or differential pressure. Alternately, tri-axial oscillator tool 26 can be activated by sending wireless commands to the electrohydraulic actuator of valve controller assembly 46.

When tri-axial oscillator tool 26 is activated, motor assembly 32 will be started to that output shaft 38 rotates. Rotation of output shaft 38 will be transmitted to translation coupling 34. Translation coupling 34 will provide an oscillatory or vibrational rotation, an oscillatory or vibrational axial, and an oscillatory or vibrational lateral motion to inertia sleeve 48. This oscillatory or vibrational movement of inertia sleeve 48 will be transmitted to string 14 to dislodge or free string 14 from stuck point 22.

Embodiments of this disclosure therefore provide systems and methods for generating oscillatory and vibratory forces proximate to the stuck point 22, which can be enough to free the stuck pipe without the need to exceed drill string tensile limits and without over-torqueing the tubular connections. In embodiments of this disclosure, the forces generated by tri-axial oscillator tool 26 can be used in combination with movements of string 14 that are applied from the surface, such as axial forces in an uphole or downhole direction, or a rotational force, or a combination of axial and rotation forces that are applied by a surface assembly.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for oscillating a string within a subterranean well, the system having:

a motor assembly having an output shaft extending along a central axis;

a translation coupling in mechanical communication with the output shaft;

an inertia sleeve in mechanical communication with the translation coupling, where the translation coupling is operable to translate a rotation of the output shaft to a oscillating movement of the inertia sleeve, where the inertia sleeve includes a plurality of ports oriented to generate a radial vibration in response to a flow of fluid; and a spring assembly in mechanical communication with the inertia sleeve, the spring assembly positioned along the central axis.

2. The system of claim 1, where the oscillating movement of the inertia sleeve includes an axial movement component in a direction parallel to the central axis.

3. The system of claim 1, where the oscillating movement of the inertia sleeve includes a lateral movement component in a direction transverse to the central axis.

4. The system of claim 1, further including a tool housing, where the tool housing is an elongated tubular member housing the translation coupling, the inertia sleeve, and the spring assembly.

5. The system of claim 1, where the spring assembly includes a plurality of stacked disc springs.

6. A system for oscillating a string within a subterranean well, the system having:

a tri-axial oscillator tool including:

a motor assembly having an output shaft extending along a central axis;

an uphole connector secured in line with an uphole string member;

a translation coupling in mechanical communication with a downhole end of the output shaft;

an inertia sleeve in mechanical communication with the translation coupling, where the inertia sleeve is rotatable by the translation coupling and the translation coupling is operable to translate a rotation of the output shaft to an oscillating movement of the inertia sleeve, the oscillating movement including an axial movement component in a direction parallel to the central axis, and where the inertia sleeve includes a plurality of ports each moveable between a port open position and a port closed position for generating a radial vibration in response to a flow of fluid; and a spring assembly in mechanical communication with the inertia sleeve, the spring assembly positioned along the central axis; where the tri-axial oscillator tool is positioned proximate to a sticking point of the string within the subterranean well.

7. The system of claim 6, where the oscillating movement of the inertia sleeve includes a lateral movement component in a direction traverse to the central axis.

8. The system of claim 6, where the tri-axial oscillator tool further includes a downhole connector secured in line with a downhole string member.

9. A method for oscillating a string within a subterranean well, the method including:

providing a motor assembly having an output shaft extending along a central axis;

mechanically connecting a translation coupling to the output shaft;

mechanically connecting an inertia sleeve to the translation coupling, where the translation coupling translates a rotation of the output shaft to an oscillating movement of the inertia sleeve, and where the inertia sleeve includes a plurality of ports, the method further including delivering a flow of fluid to the plurality of ports and moving the plurality of ports between a port open and a port closed position to generate a radial vibration of the inertia sleeve;

positioning a spring assembly along the central axis in mechanical communication with the inertia sleeve, where the motor assembly, the translation coupling, the inertia sleeve, and the spring assembly define a tri-axial oscillator tool; and rotating the output shaft to produce the rotation and the oscillating movement of the inertia sleeve.

10. The method of claim 9, further including securing the tri-axial oscillator tool in line with an uphole string member with an uphole connector.

11. The method of claim 9, further including securing the tri-axial oscillator tool in line with a downhole string member with a downhole connector.

12. The method of claim 9, where producing the oscillating movement of the inertia sleeve includes producing an axial movement component in a direction parallel to the central axis.

13. The method of claim 9, where producing the oscillating movement of the inertia sleeve includes producing a lateral movement component in a direction transverse to the central axis.

14. The method of claim 9, further including housing the translation coupling, the inertia sleeve, and the spring assembly within a tool housing, where the tool housing is an elongated tubular member.

15. The method of claim 9, where positioning the spring assembly along the central axis includes positioning a plurality of stacked disc springs along the central axis.

16. The method of claim 9, further including positioning the tri-axial oscillator tool proximate to a sticking point of the string within the subterranean well.

17. The method of claim 9, where the motor assembly includes a rotor and a stator and the method further includes rotating the rotor within the stator by providing a flow of fluid to the motor assembly.

* * * * *